US007754968B2

(12) United States Patent
Fällström

(10) Patent No.: US 7,754,968 B2
(45) Date of Patent: Jul. 13, 2010

(54) SLEEVE ADAPTED FOR A CRIMPING PROCESS

(75) Inventor: Per Axel Fällström, Kramfors (SE)

(73) Assignee: Elpress AB, Kramfors (SE)

( * ) Notice: Subject to any disclaimer, the term of this patent is extended or adjusted under 35 U.S.C. 154(b) by 0 days.

(21) Appl. No.: 12/035,799

(22) Filed: Feb. 22, 2008

(65) Prior Publication Data

US 2008/0223614 A1 Sep. 18, 2008

Related U.S. Application Data

(63) Continuation of application No. PCT/SE2006/050255, filed on Jul. 10, 2006.

(30) Foreign Application Priority Data

Aug. 22, 2005 (SE) ..... 0501848

(51) Int. Cl.
*H01R 4/18* (2006.01)

(52) U.S. Cl. ..... 174/84 C

(58) Field of Classification Search ..... 174/84 C, 174/94 R

See application file for complete search history.

(56) References Cited

U.S. PATENT DOCUMENTS 445,479 A * 1/1891 Short ..... 238/14.2
3,050,930 A * 8/1962 Fritsch ..... 368/164
3,387,080 A 6/1968 Dibble et al.
3,408,455 A * 10/1968 Dannes ..... 174/94 R
4,940,856 A 7/1990 Bock
4,950,838 A 8/1990 Gordon
5,635,676 A * 6/1997 Piriz ..... 174/84 C
6,004,165 A * 12/1999 Dinh et al. ..... 439/783

FOREIGN PATENT DOCUMENTS

GB 789523 A 1/1958

OTHER PUBLICATIONS

International Search Report dated Oct. 3, 2006.
European Search Report (Nov. 13, 2009, 3 pages).

* cited by examiner

*Primary Examiner*—Chau N Nguyen
(74) *Attorney, Agent, or Firm*—The Maxham Firm

(57) ABSTRACT

A branch sleeve adapted to carry out a crimping process around mutually parallel electrically conductive conductor sections. The sleeve includes a first groove-shaped recess which connects with a second groove-shaped recess and with an open part that extends between the recesses. The first recess is adapted to freely embrace or surround a first conductor section, and the second recess is adapted to freely embrace or surround a second conductor section, wherein each of the recesses has an opening area which conforms with and exceeds the largest conductor-section area, for which the sleeve is dimensioned. The sleeve has a cross-sectional shape in the form of a stylized digit "three." The distribution of material around the recesses of the branch sleeve, or a so-called 3-sleeve, and the form and orientation of the recesses, are mutually adapted to create reducing gatherings of material inter alia adjacent to and at a small distance from said open part, and increasing gatherings of material at the leg parts.

8 Claims, 3 Drawing Sheets

SLEEVE ADAPTED FOR A CRIMPING PROCESS

FIELD OF THE INVENTION

The present invention relates generally to a sleeve adapted for a crimping process, a so-called C-sleeve or branch sleeve where the sleeve is intended particularly for a mechanically and electrically coordinating of two mutually parallel electrically conductive conductor sections, by means of a known crimping process, in which two crimping jaws are pressed together to cause a plastic flow of material within the sleeve and of material within the conductor sections. The conductor sections intended for the C-sleeve are normally stripped of their insulation to consist of or exposing bare wire sections. More particularly, the present invention relates to such a C-sleeve with which the shaped intact cross-section (not compressed) includes a first groove-shaped recess, which connects with and merges into a second groove-shaped recess, with an edge-orientated open part, which extends between the recesses and which is coordinated therewith.

BACKGROUND OF THE INVENTION

Several different embodiments of methods, arrangements and constructions related to the above technical field and to a branch sleeve adapted for a crimping process, and more particularly to a so-called C-sleeve, are known in the art.

C-sleeves of this kind have, when intact, mutually different cross-sectional shapes so that the sleeve will have an internal configuration that is adapted to a chosen cross-sectional range with regard to the conductor sections involved, and with an external configuration that is adapted to the crimping or clamping jaws used.

FIG. 1 in the accompanying drawing is a perspective view of an intact earlier known branch sleeve that is comprised of copper, a copper alloy or similar conductive material and intended for splicing and branching earth lines or for the construction of lightening arrestor installations, with the aid of one or two impressions achieved with the aid of crimping or clamping jaws.

C-sleeves or branch sleeves of this kind are designed and dimensioned for one or two conductor sections and are retailed and stored under different designations.

In this respect, it is earlier known for these C-sleeves to have different designations, such as C8-6, C8, C9-6, C9-8 and C9, so as to be able to cover the following area ranges: 25-35/16-25; 25-35/25-35; 35-50/16-25; 35-50/25-35; and 35-50/35-50 $mm^2$.

It will be noted that an intact C-sleeve designated C8-6 is intended for a co-action with a chosen second conductor section, falling within the area range of 16-25 $mm^2$ and with a chosen first conductor section, falling within the area range of 25-35 $mm^2$.

It is earlier known that certain of said coordinated C-sleeves require crimping or clamping jaws in a crimping tool of a first embodiment, whereas other coordinated C-sleeves require crimping or clamping jaws of a different construction or configuration, or both.

The practical application, the manufacture and storage of such intact C-sleeves thus require a very large number of mutually different external dimensions and mutually different internal recesses, adapted to accommodate different selected conductor areas.

The reason why these C-sleeves with their allotted cross-sectional shapes occur in so many shapes of embodiments and are adapted directly to special conductor sections and conductor areas is because of the demands and requirements that are placed on a crimping connection formed via uniting conductor sections in a crimping process, carried out by using such a sleeve.

The requirement placed on these C-sleeves is that after having undergone a crimping process in one or more stages, the outer compressed form of the C-sleeve shall have been changed equally around the two conductor section as a result of a structural material change, with an associated coordinated plastic flow of material particularly within the peripheral region of the conductor sections, so as to obtain a mechanically durable and an electrically acceptable connection.

These strength related requirements and electrical requirements, such as with respect to transition resistance, are well documented and standardized.

Considering the basic idea related to the present invention and the technique from which the present invention originates the content of the U.S. Pat. No. 4,940,856 to Bock must be mentioned as a relevant prior art. This publication does describe and illustrate an electrical connector for connecting a first conductor to a second conductor.

The electrical connector in Bock includes a generally C-shaped or 3-shaped body, which defines first and second conductor receiving cavities for accommodating the respective conductors. The body member is provided with an opening communicating with the conductor receiving cavities, by means of which the conductors are adapted to be positioned within said cavities. An integral hinged connected retaining member is associated with one of the conductor receiving cavities whereby, once a conductor has been placed in the latter cavity, the retaining member may be manually rotated to a position wherein it secure the conductor in the cavity. The connector is than intended to be placed over a second conductor, such that the second conductor is received in the other conductor receiving cavity. The connector is adapted to be compressed, by means of a compression tool, so as to substantially close the opening in the body member.

SUMMARY OF THE INVENTION

C-sleeves of the kind intended here thus include a first recess, which is adapted to enable it to freely surround or embrace a first conductor section, and a second recess, which is adapted to enable it to freely surround or embrace an another or a second conductor section.

The groove-shaped recesses and the open part are mutually shaped and disposed to enable a so-called "lateral-infeed" of conductor sections, whereas the groove-shaped recesses and the open part are also mutually shaped and disposed to enable a so-called "frontal infeed" of a first conductor section, when a second conductor section is located in free co-action with the recess assigned to the second conductor section.

Each of the recesses shall be adapted with an open area that conforms with and only slightly exceeds a sleeve-adapted largest area dimensioned, falling within a chosen cross-sectional range of a chosen conductor section.

In the following description a branch sleeve is said to be "intact" when the sleeve has not been influenced by any crimping jaws or clamping jaws and is said to be "compressed" when it has been influenced by said crimping jaws or clamping jaws while enclosing the conductor sections.

More precisely the present invention relates to a branch sleeve intended for crimping two electrically conductive conductor sections positioned parallel with one another, wherein said sleeve includes a first groove-shaped recess, which connects with a second groove-shaped recess and with an open part extending between said recesses and coordinated therewith.

The first recess, via a first leg section, is adapted to freely embrace a first conductor section and the second recess, via a second leg section, is adapted to freely embrace a second conductor section, and wherein the recesses and associated leg sections are each adapted with an opening area that conforms to and exceeds the largest conductor-section area for which the sleeve is dimensioned.

The sleeve has the form of a stylized digit "three," whereby a material concentration or distribution, intermediate said recesses, in respect of the branch sleeve, is formed as a centrally oriented larger or increased material gathering or concentration.

Technical Problems the Present Invention Addresses

When taking into consideration the technical deliberations that a person skilled in this particular art must make in order to provide a solution to one or more technical problems that he/she encounters, it will be seen that on the one hand it is necessary initially to realize the measures and/or the sequence of measure that must be undertaken to this end, and on the other hand to realize which means is/are required in solving one or more of said problems. On this basis, it will be evident that the technical problems listed below are relevant to the development of the present invention.

When considering the earlier standpoint of techniques, as described above, and especially the content of the above mentioned US-patent, it will be evident that a technical problem resides in the ability to realize the significance of, the advantages that are benefited by and the technical measures and deliberations that will be required in causing or creating, in respect of the use of a single branch sleeve, conditions which enable this branch sleeve to be used for a connection of conductor sections, with the aid of a chosen crimping process and with the use of more varying conductor-section areas while, nevertheless, achieving the safety required by the criteria placed on a compressed branch sleeve and on a mechanically and electrically sound and acceptable connection.

A technical problem will then reside in the ability to realize the significance of, the advantages that are benefited by and/or the technical measures and deliberations that will be required in using a crimping method or a crimping process in respect of two mutually parallel electrically conductive sleeves or sections that, when intact, define a branch sleeve that has a cross-section defined by a first groove-shaped recess, closely connected to a second groove-shaped recess with an open part extending between the recesses and coordinated therewith, wherewith the first recess is conveniently adapted to enable it to freely enclose a first conductor section while the second recess is conveniently adapted to freely enclose a second conductor section, wherein the groove shaped recesses and the peripherally disposed open part may mutually be formed and disposed to enable a lateral infeed of a conductor section while, in addition, enabling the groove-shaped recesses and the open part to be mutually shaped and disposed to enable a frontal infeed of a conductor section, when a second conductor section is already located in free coaction with a conductor-section allotted recess, with each of the recesses adapted to an opening area conforming with and slightly exceeding a largest area of the sleeve dimensioned for the conductor section, while providing conditions for giving the intact branch sleeve a cross-sectional shape conforming to a stylized digit "three" and therewith allow a material distribution about the recesses for the inventive branch sleeve or "3"-sleeve and to form and orientate the recesses so as to mutually adapt the recesses for achieving one or more locally dispersed reducing material gatherings adjacent to and at a small distance from said open part, and to obtain increasing material gatherings within sleeve parts are predominantly related to a standardized intact C-sleeve or branch sleeve.

More specially there is to be considered as a technical problem to realize the significance of, the advantages that are benefited in and/or the technical measures or deliberations that will be required in providing a form and an orientation of the recesses and related to the leg sections that are mutually adapted to form, in relation to and in the direction from a centrally oriented larger material gathering or concentration partly two, each leg section related, the larger material concentration adjacent, lesser or reduced gatherings of material partly two, the lesser or reduced gatherings of material adjacent and leg sections related, larger or increased gatherings of material and partly two, the larger or increased gatherings of material (A, B) adjacent, smaller or reduced gatherings of material, formed for causing terminating tips of the leg sections.

Another technical problem resides in the ability to realize the significance of, the advantages that are benefited in and/or the technical measures or deliberations that will be required in providing an area range, that lies within chosen wide limits, such as between 50 and 10 $mm^2$, for instance, in respect to a chosen lateral infeed of a conductor section with an adapted conductor area.

Another technical problem resides in the ability to realize the significance of, the advantages that are afforded by and/or the technical measures and deliberations that will be required in allowing area ranges, that lie within chosen wide limits, such as between 30 and 10 $mm^2$ for instance, in respect of a chosen frontal infeed of a conductor section that has an adapted conductor area.

Another technical problem resides in the ability to realize the significance of, the advantages that are benefited by and/or the technical measures and deliberations that will be required in allowing the shape of the 3-sleeve and its leg sections to be changed through the medium of a successive rolling motion in the case of a crimping process carried out in one or two stages or steps, the rolling motion successively closing the open part by adapted plastic flow or migration of the sleeve material around the conductor sections and with a change in the conductor sections resulting from plastic flow of the material, so as to obtain a mechanically and electrically acceptable connection when the branch sleeve is fully compressed.

A technical problem also resides in the ability to realize the significance of, the advantages that are benefited by and/or the technical measures and deliberations that will be required in allowing said 3-sleeve and/or the material in the conductor section to comprise mutually the same material, and then particularly pure copper, copper alloy and/or similar electrically conductive material.

A technical problem also resides in the ability to realize the significance of, the advantages benefited by and/or the technical measures and deliberations that will be required in allowing the recesses to be adapted for co-action with conductor sections and/or end related conductor sections, which are intended to be spliced so as to provide a branch in an earth line and/or a lightening arrester installation.

Another technical problem also resides in the ability to realize the significance of, the advantages that are benefited by and/or the technical measures and deliberations that will be required in allowing the distribution of material in an intact 3-sleeve to be adapted for replacement of a plurality of particularly structured standardized C-sleeves exposing more narrow area limits.

Another technical problem resides in the ability to realize the significance of, the benefits that are afforded by and/or the technical measures and deliberations that will be required in allowing increasing material gatherings to be concentrated to central regions of the leg sections that respectively define the first recess and the second recess.

Another technical problem resides in the ability to realize the significance of, the advantages that are benefited by and/or the technical measures and deliberations that will be required in allowing one of the recesses and its related leg section to have a larger encasing area than an adjacent recess.

Another technical problem resides in the ability to realize the significance of, the advantages that are benefited by and/or the technical measures and deliberations that will be required in allowing an intact 3 sleeve to include parts that include a material increase and a material reduction with the material reductions coordinated between the material increases.

Another technical problem resides in the ability to realize the significance of, the advantages that are benefited by and/or the technical measures and deliberations that will be required in allowing the exposed legs of the 3-sleeve to be asymmetrical in the sense of being displaced towards one another and therewith orientated in overlapping relationship, particularly in the case of finer conductor areas.

Another technical problem resides in the ability to realize the significance of, the advantage that are benefited by and/or the technical measures and deliberations that will be required in allowing an intact 3-sleeve to be formed where a smaller cross-section can favour a folding or rolling movement caused by known crimping jaws in a crimping tool.

Another technical problem resides in the ability to realize the significance of, the advantages that are benefited by and/or the technical measures and deliberations that will be required in allowing an intact 3-sleeve to be formed, with which it is possible to reduce the amounts of material required in all three directions without detracting from the electrical and mechanical properties required within the area of use in question.

Solutions Provided by the Present Invention

The present invention takes as its starting point the earlier known standpoint of techniques mentioned in the introduction in respect of an intact branch sleeve, a socalled C-sleeve or 3-sleeve, adapted for a crimping process around two mutually parallel electrically conductive conductor sections, wherein the C-sleeve or 3-sleeve includes in cross-section a first groove-shaped recess located adjacent a second groove-shaped recess and including between the recesses an open part, wherein the first recess is adapted to freely embrace or surround a first, largest conductor section while the second recess is adapted to freely embrace or surround a second largest conductor section, wherein the groove-shaped recesses and the peripherally open part will preferably be shaped and arranged to enable a lateral infeed to be achieved, whereas the groove-shaped recesses and the peripherally open part will preferably be formed and arranged to enable a frontal infeed of a conductor section when a second conductor section is already located in a recess assigned for free co-action with a conductor section, wherein each of the recesses has a chosen opening area conforming to and exceeding a largest conductor-section area for which the sleeve is dimensioned.

The present invention is based upon the insight that said sleeve has to expose the form of a stylized digit "three," whereby a material distribution intermediate the recesses and related between the two leg sections, in respect of the branch sleeve, is formed with a centrally oriented larger or increased material gathering or concentration.

With the intention of solving one or more of the above technical problems it is proposed, particularly in accordance with the present invention, that the known technology is supplemented by allotting an intact branch sleeve the form and orientation of the recesses and related to the leg sections are mutually adapted to form, in relation to and in the direction from the centrally oriented larger material gathering or concentration partly two, each leg section related, the larger material concentration adjacent, lesser or reduced gatherings of material partly two, the lesser or reduced gatherings of material adjacent and leg sections related, larger or increased gatherings of material and partly two, the last mentioned larger or increased gatherings of material adjacent, smaller or reduced gatherings of material, formed for causing terminating tips of the leg sections.

By way of proposed embodiments that lie within the framework of the inventive concept it is also proposed that in respect of a lateral infeed of the conductor section the area of the section will lie within given chosen ranges, such as between 50 and 10 $mm^2$, while the area of the conductor section in respect of a frontal infeed will be chosen to lie within a second chosen area range, such as a range between 35 and 10 $mm^2$.

It is also proposed in accordance with the invention that in the case of a crimping process comprising one or two stages or steps the outer and inner shapes of the 3 sleeve will be changed via a compressive plastic flow or migration of material around the conductor section equal to the cross-section of the conductor sections and primarily the peripheral region thereof, so that this change, resulting from the plastic flow of the material, will result in a permanent mechanically and electrically acceptable connection.

The invention is based on the sleeve material and/or the material of the conductor sections consisting of mutually the same material, particularly pure copper or copper alloys.

More particularly, it is proposed, in accordance with the invention, that a 3-sleeve is adapted to co-act with conductor sections and/or end-related conductor sections through the medium of said recesses, such as to obtain a branch in an earth line and/or a lightning arrester installation.

It is also proposed, in accordance with the present invention, that the material divisions within the 3-sleeves are adapted for the replacement of a number of particularly structured narrow-area-adapted and standardized C-sleeves.

More particularly, it is proposed that the increasing material gatherings are concentrated to the midway region of the leg section that defines the first recess on the one hand and to the midway region on the leg section that defines the other recess on the other hand.

It is also proposed, in accordance with the present invention, that one of the recesses is formed so as to have a greater embracing area than an adjacent recess.

ADVANTAGES RESULTING FROM THE PRESENT INVENTION

Those advantages afforded primarily by the present invention and through the medium of its particular characteristic features reside in creating conditions in which, while using one and the same known and tested crimping process with the aid of an intact branch sleeve, the cross-section of the sleeve and its material distribution can be changed and thereby enable a conductor section to be firmly squeezed or clamped, with conductor areas that lie within pre-determined limit values regardless of whether a used conductor section has a large conductor area or a used conductor section has a finer conductor area, within a given large area range, such that the crimping process is able to provide a mechanically and electrically accepted connection in a fully compressed state, through the medium of one or two impressions.

According to the invention the technical effect is based on an outer distribution of material around the sleeve recesses and the internal shape for orientation of the recesses are mutually adapted, among other things, to create reducing material gatherings adjacent to and at a small distance from an open part and increasing material gatherings within sleeve parts that are situated closely to the reducing material gatherings related to a standardized sleeve where the total consumption of material in respect of the inventive 3-sleeve is less than the material consumption of a standardized C-sleeve adapted for conductor sections and conductor cross-sections lying within the midway region of the increased area range.

More particularly it is a question that the intact 3-sleeve shall have a smaller cross-section than the known C-sleeve, in order for a folding and rolling movement of the leg sections generated by the design of the known crimping jaws to favour the compression sequence in respect of a fully acceptable compression.

BRIEF DESCRIPTION OF THE DRAWING

The features, objects, advantages, and applications of the invention will become more evident from the following detailed description, when read in conjunction with the accompanying drawing, wherein.

DESCRIPTION OF AN EARLIER KNOWN INTACT BRANCH SLEEVE, A SO-CALLED C-SLEEVE, ACCORDING TO FIGS. 1 TO 4 AND 7

Figure 1:
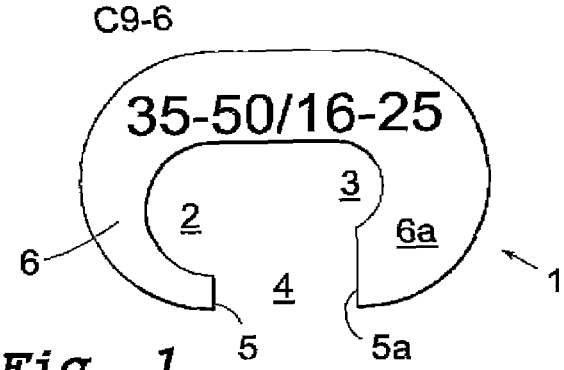
Fig. 1 (PRIOR ART)
FIG. 1 is a side view of the known intact C-sleeve, known in the prior art.

FIG. 1 is a side view of an intact branch sleeve, a so-called C-sleeve 1, which is adapted for a crimping process about two mutually parallel electrically conductive conductor sections.

C-sleeve 1 has a "C"-shaped inner and outer cross-section with first inner groove-shaped recess 2 that is in direction connection with inner second groove-shaped recess 3 and open part 4, defined by end parts 5, 5*a*, which extends between the recesses and is coordinated therewith.

First recess 2 is intended to freely surround or embrace first conductor section 2*a* and second recess 3 is intended to freely surround or embrace second conductor section 3*a*.

Figure 2:
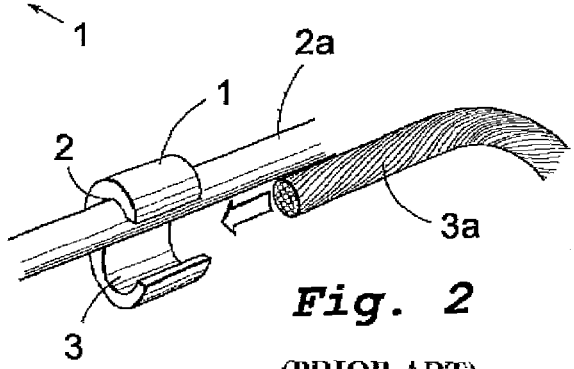
Fig. 2 (PRIOR ART)
FIG. 2 illustrates the principles in which a conductor section is fed sideways into an intact C-sleeve, according to FIG. 1.
Figure 3:
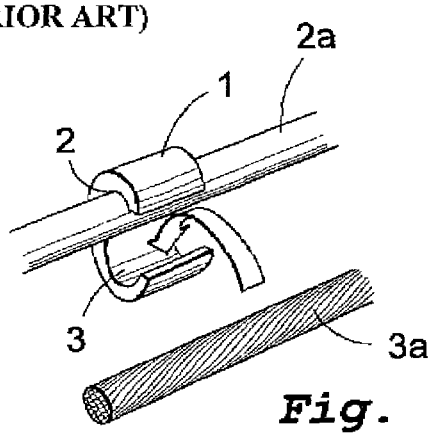
Fig. 3 (PRIOR ART)
FIG. 3 illustrates the principles of frontal infeed of a conductor section in respect of an intact C-sleeve, according to FIG. 1, when another conductor section or several other conductor sections is/are already present and situated for free coaction with a recess bordering on the conductor section.

Groove-shaped inner recesses 2, 3 and open part 4 are mutually formed and disposed so as to allow a lateral infeed of the conductor sections, according to FIG. 2, whereas the groove-shaped inner recesses and the open part are mutually formed and arranged to enable a frontal infeed of conductor section 3*a*, according to FIG. 3, when another or several other conductor sections 2*a*, is located in recess 2 for free co-action with the conductor section.

Each of recesses 2, 3 has an opening area, which conforms with and slightly exceeds the greatest area of respective conductor sections 2*a*, 3*a*, for which the sleeve is dimensioned.

FIG. 2 thus illustrates the conditions or prerequisites for a lateral infeed of a conductor section and FIG. 3 illustrates the conditions or prerequisites for a frontal infeed of conductor section 3*a*, when another or several other conductor sections 2*a* is situated for free co-action with recess 2, allotted to the conductor section.

Figure 4:
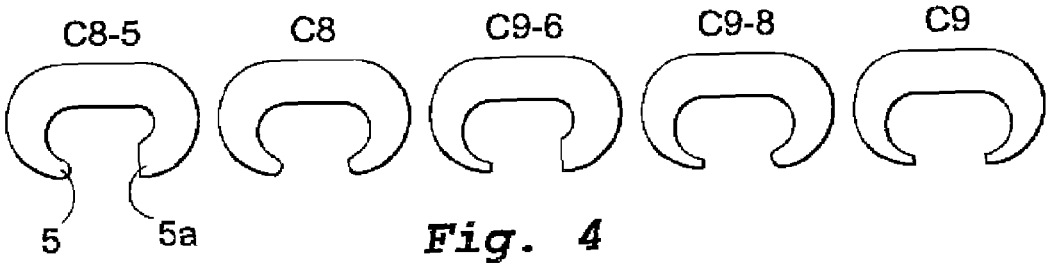
Fig. 4 (PRIOR ART)
FIG. 4 illustrates cross-sections of five intact C-sleeves of known cross-section although the first (4*a*) and the last (4*b*) C-sleeve in a compressed state.

FIG. 4 illustrates five mutually different intact C-sleeves, designated C8-5; C8; C9-6; C9-8 and C9, each of these sleeves being intended for a chosen conductor-area combination, however exposing narrow limits.

For example, the intact C-sleeve C8-5 is intended to cover conductor areas of 25-35 $mm^2$ in respect of a first conductor section and conductor areas of 16-25 $mm^2$ in respect of a second conductor section.

C-sleeve C8 shall thus cover conductor areas of 25-35 $mm^2$ and 25-35 $mm^2$ respectively, C-sleeve C9-6 shall thus cover conductor areas of 35-50 $mm^2$ and 16-25 $mm^2$ respectively, C-sleeve C9-8 shall thus cover conductor areas of 3550 $mm^2$ and 25-35 $mm^2$ respectively, and C-sleeve C9 shall thus cover conductor areas of 35-50 $mm^2$ and 35-50 $mm^2$ respectively.

Figure 4A:
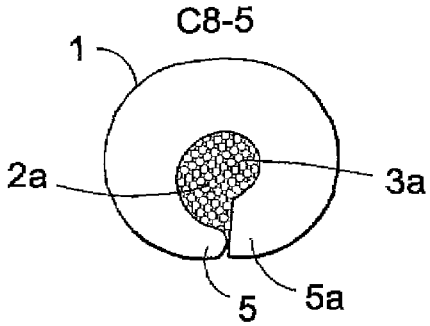
Fig. 4a (PRIOR ART)
Figure 4B:
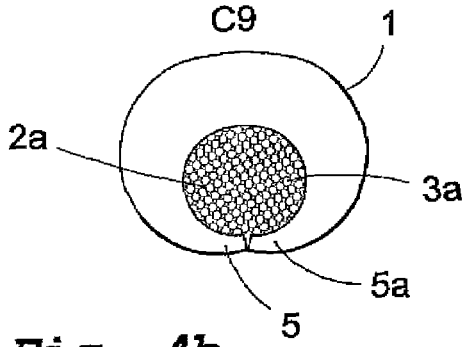
Fig. 4b (PRIOR ART)

FIG. 4*a* is intended to illustrate the cross-section of a C-sleeve 1 that has been compressed around or about two conductors 2*a*, 3*a*, with sleeve C8-5 (25-35), while FIG. 4*b* is intended to illustrate the cross-section of a C-sleeve compressed about two conductors 2*a*, 3*a*, with sleeve C9 (50-50).

The known technique illustrated here clearly shows that the end parts 5, 5*a* of the intact C-sleeve 1 are abruptly bevelled and asymmetrical and that these end parts will knock against each other in the initial crimping process before migration or plastic flow of the material has commenced.

Figure 7:
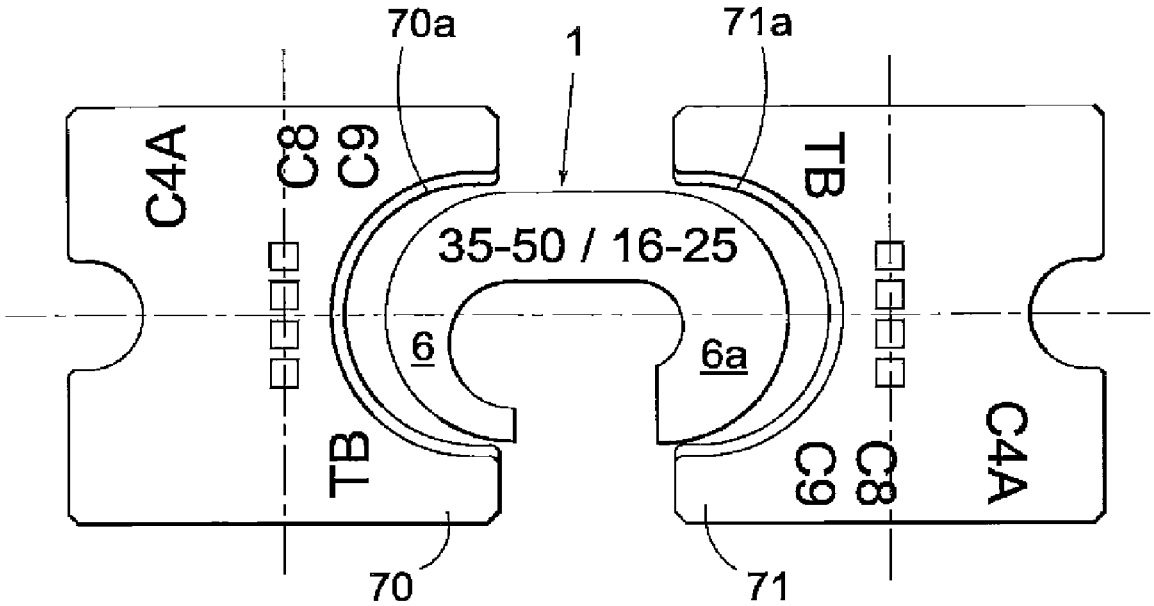
Fig. 7 (PRIOR ART)
FIG. 7 illustrates an intact C-sleeve (35-50/16-35) according to the prior art placed between two crimping jaws in a crimping tool.

Reference is made to the illustration in FIG. 7 in this respect.

DETAILED DESCRIPTION OF THE PREFERRED EMBODIMENTS

Figure 5:
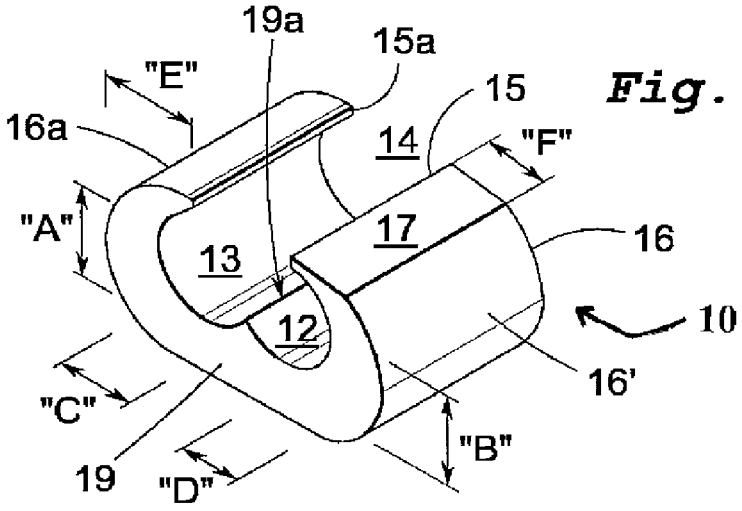
FIG. 5 is a perspective illustration of a 3-sleeve, according to the present invention.
Figure 8:
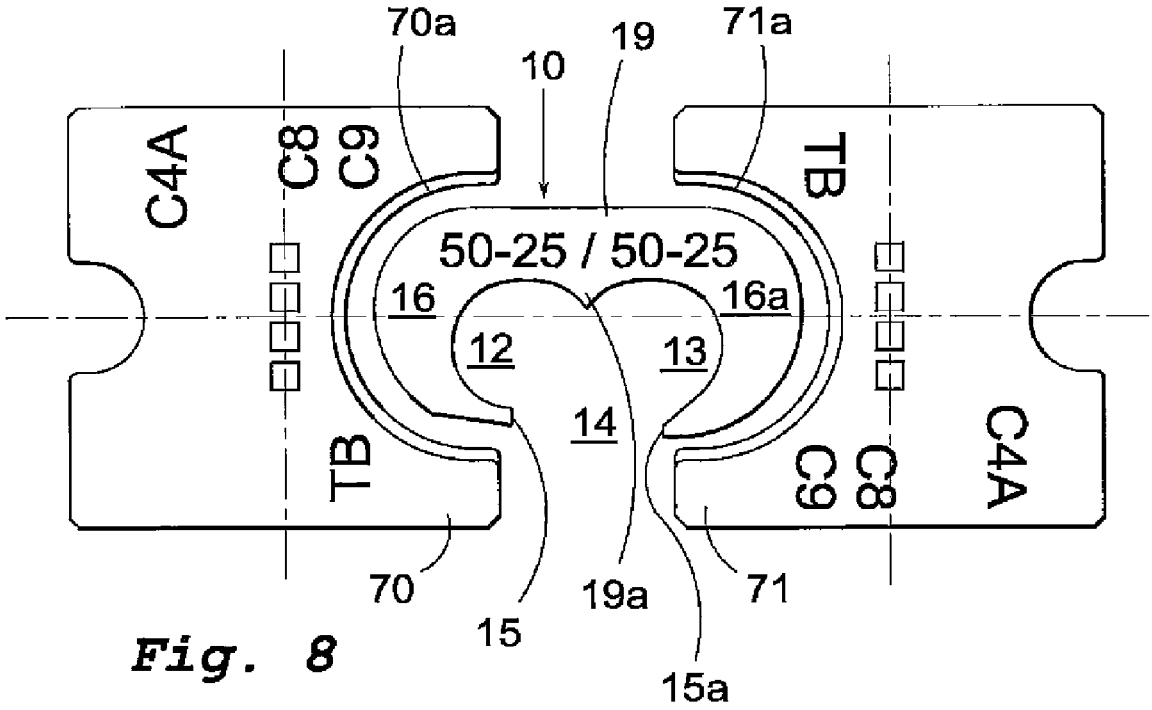
FIG. 8 illustrates an intact 3-sleeve (50-15/50-15) according to this invention placed between two crimping jaws of the known design (FIG. 7).

The following description will be used with respect to an embodiment at present preferred and including significant characteristic features of the invention as illustrated in FIGS. 5, 6, and 8 of the accompanying drawing. Special terms and terminology are employed with the primary intention of clearly illustrating the inventive concept. However, it will be noted that the expressions chosen here shall not be seen as limited solely to the chosen terms used in the description but that each term chosen shall be interpreted as also including all technical equivalents that function in the same or at least essentially in the same way so as to achieve or essentially achieve the same purpose or the same technical effect, or both.

The accompanying FIGS. 5, 6, and 8 thus illustrate schematically and in detail the basic prerequisites of the present invention, where the significant features of the invention have been concretized in the following specifically described embodiment at present proposed.

Reference is now made in particular to the perspective illustration of FIG. 5, from which it will be seen that an intact branch sleeve, according to the invention, has a cross-section which differs from the known cross-section of a known C-sleeve (according to FIG. 1).

In view of this change in cross-sectional form or shape the branch sleeve, according to the present invention, is hereinafter referred to as a 3-sleeve and has been generally referenced with reference numeral 10.

The differences existing between an intact C-sleeve and an intact 3-sleeve will best be seen from a comparison between FIGS. 7 and 8 and the crimping jaws illustrated in these FIGs.

According to the invention, special attention will be made to the outer changing material distributions around recesses 12, 13, in respect of 3-sleeve 10.

The form and orientation of respective recesses 12, 13, are mutually adapted to create material reducing gatherings, referenced "E" and "F," at end parts 15, 15*a*. These gatherings extend at a small distance from open part 14, and successively increasing material gatherings "A" and "B" within the leg sections or sleeve portions 16, 16*a*, close to said reducing material gatherings "E" and "F" related to a standard intact C-sleeve 1.

Figure 6A:
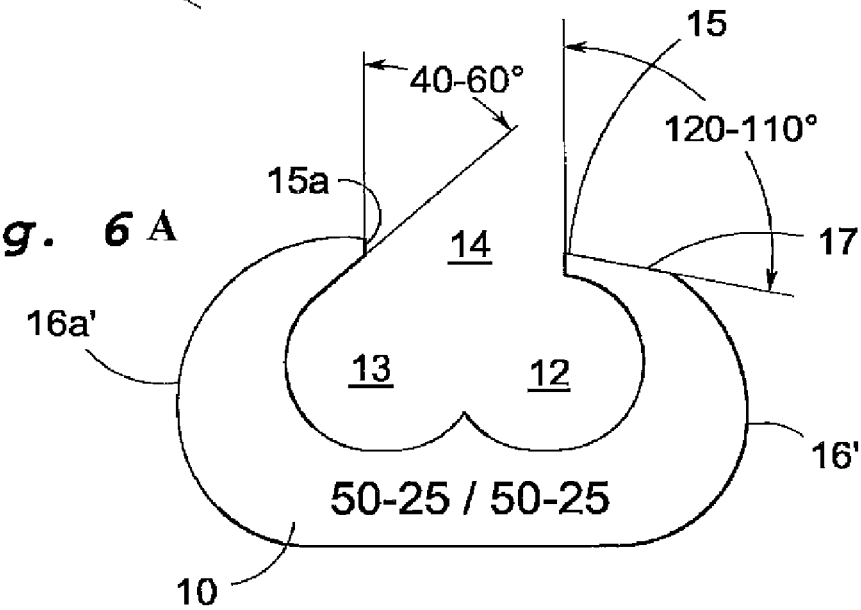
FIG. 6A is a side view of a chosen intact 3-sleeve of FIG. 5, in a non-compressed state, showing a number of measurement values and angle values, significant of an intact 3-sleeve of the 50-25/50-25 $mm^2$ designation.

In the case of a lateral infeed, according to FIG. 2, the embodiment illustrated in FIGS. 5 and 6A utilizes a conductor section, whose conductor area is chosen within a selected range, such as between 50 and 10 $mm^2$, whereas in the case of a frontal infeed, according to FIG. 3, there is chosen a conductor section that has a conductive area, that lies within another chosen range, such as between 35 and 10 $mm^2$.

According to the invention, in a crimping process that is carried out in one or two stages or steps, the process shall cause the outer form of the intact 3-sleeve to change and to surround the conductor sections 2*a*, 3*a* and the conductor sections 2*a*, 3*a* themselves so as to obtain a compressed connection that is both mechanically and electrically acceptable. This is illustrated in more detail in FIGS. 6B and 6C.

According to the present invention, the 3-sleeve and/or the conductor sections shall consist of copper and/or copper alloys, commonly used in this application and technical field. The inventive intact 3-sleeve 10 and its associated recesses 12, 13 are adapted for co-action with conductor sections and/or end-related conductor sections that are to be spliced, such as to form a branch in an earth line and/or a lightning arresting installation.

It has been found that this material distribution, according to the invention, can be adapted so as to enable the replacement of a number, such as five (5) in FIG. 4, especially structured, area adapted and standardized intact C-sleeves, according to FIGS. 1 and 7.

As shown in FIG. 5, the increasing material gatherings shall be concentrated to central region 16' of leg section 16 that defines the first recess 12, and to central region 16*a* of leg section 16*a'* that defines recess 13, and to part 19 that interconnects leg sections 16, 16*a*, where material gathering 19 can be structured as an inwardly directed shoulder 19*a*, so as to form a support edge and a stiffening element during the crimping process.

In addition, shoulder 19*a* is further intended to form a stiffening against a tendency of the 3-sleeve to curve in its longitudinal extension.

One of the recesses 12, 13 may have, via its leg section, a larger embracing or surrounding area than the recess adjacent thereto (not shown but can conform to the cross-section shown in FIG. 1).

When considering the present invention in the light of what has been described above, it will be seen that the proposed intact 3-sleeve fulfills the basic requirements of functionality with respect of its electrical purpose with a small transitional resistance while affording a large working and/or contact area with an optimized material content.

With respect to mutually joining two multi-wire copper conductors the invention provides many combinations with regard to conductor sizes, wherewith when the intact 3-sleeve is compressed with the aid of a crimping tool designed to this end there is created and formed a uniform distribution of material while achieving a compact material cross-section with the electrical and mechanical properties optimized in respect of a chosen working area.

The intact 3-sleeve 10 has also been formed with a cross-section which, in response to the compressive forces exerted by the crimping jaws of the crimping tool, causes the occurrence of a folding and/or rolling motion within the material of the 3-sleeve and then in particular in its leg sections 16, 16*a*, this motion making possible a large working range and a combination of different conductors and conductor areas. This folding and rolling motion shall be pronounced during the entire compression process to improve the resistance and the tear force.

Moreover, the intact 3-sleeve shall be dimensioned in all three directions so that the forces that are applied during the crimping process will result in an optimal or at least generally optimal degree of plastic deformation throughout the entire cross-section area, in respect of maximal and minimal permitted conductor areas, proposed conductor areas and existing combinations of conductor areas.

Figure 6B:
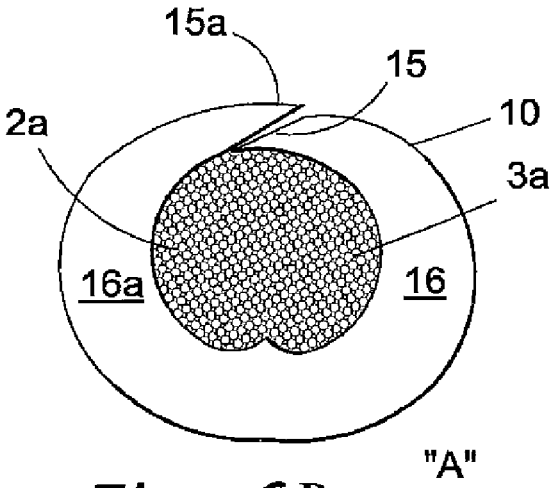
FIG. 6B shows a 3-sleeve according to this invention in a compressed state while using a section corresponding to 25/25 $mm^2$.
Figure 6C:
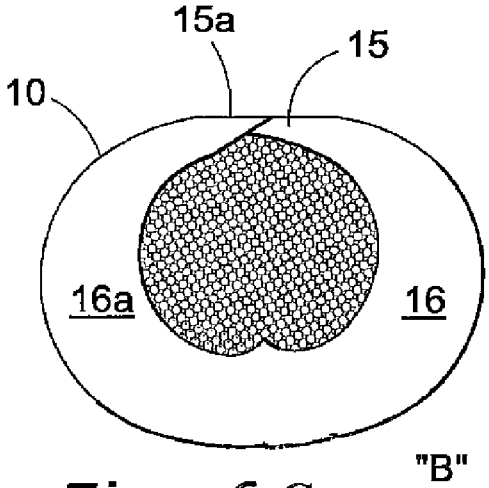
FIG. 6C shows the 3-sleeve according to this invention while using a conductor section of 50/50 $mm^2$ where significant overlapping of the free leg parts significant to the invention is illustrated in detail.

FIGS. 6B and 6C show that the free parts or tips 15, 15*a* of the leg sections overlap and accompany one another, by a relative movement during the crimping process.

Referring back to FIG. 5 it can be mentioned that a region "A" and an opposing region "B" have both been given relatively more material (than the embodiment according to FIG. 1) so as to ensure the presence of sufficient material in the case of conductor combinations of smaller cross-sectional areas.

The regions "C" and "D" constitute regions of relatively small material gathering, so as to facilitate said folding or rolling motion around the larger material gathering 19 and its shoulder 19*a*.

The regions "E" and "F" constitute asymmetrically shaped leg sections 15, 15*a*, which have been given this form so as to facilitate the embracing rolling motion and forming, particularly in the case of conductor combinations of smaller cross-sectional areas.

FIG. 6A illustrates chosen dimensions for an intact 3-sleeve (50-25/50-25) and particularly emphasizes the different angular values concerned. It will be understood that other measurements are applicable to other intact 3-sleeves.

Reference is made in particular to planar part 17 and to the fact that this part is orientated "beneath" the apex or the end-part or tip 15*a* through a chosen distance, meaning that the apex or end-part or tip 15 will creep beneath the end-part 15*a* when a rolling tendency is activated.

FIG. 7 is intended to illustrate an intact prior art C-sleeve 1 inserted between crimping jaws 70 and 71 that include semi-cylindrical recesses 70*a* and 71*a* whose respective radii are slightly smaller than the radius of the C-sleeve leg section so that an initial compression of the leg section apexes or end-parts 5, 5*a* (see FIG. 1), takes place. The space defined between recesses 70*a*, 71*a* and a coordinated leg section 6, 6*a* has a crescent shape.

FIG. 8 is intended to illustrate an intact 3-sleeve 10 according to the invention inserted between the clamping jaws 70 and 71.

In this case the radius of respective recesses 70*a*, 71*a* is adapted directly to the outer form of 3-sleeve leg sections 16, 16*a* and consequently the crimping process will begin with a pronounced rolling movement of leg sections 16, 16*a* around a sub-part and gathering 19 will be pressed upward in FIG. 8 as one end-part 15 passes beneath the other end-part 15*a*.

Thus, it can be seen from a comparison between FIGS. 7 and 8 that C-sleeve 1 in FIG. 7 and 3-sleeve 10 in FIG. 8 have slightly different intact cross-sections. Both sleeves 1 and 10 are placed in the same crimping jaws to describe the fact that a smaller cross-section of the novel 3-sleeve favors a folding or rolling movement, caused by the surfaces 70*a*, 71*a* of the crimping tool.

The novel design enables the material volume to be reduced in all three directions, thus also the length, without detracting from electrical or mechanical requirements within the field of use concerned.

For example, it can be mentioned that an intact 3-sleeve, referenced C8, C9 in FIG. 8, weighs 40 g, whereas five existing C-sleeves, that can be replaced by the inventive 3-sleeve, weigh 60, 57, 60, 53, and 51 g respectively, thus providing a significant primary material saving.

The secondary significant saving is, of course, the logistic saving achieved by fewer different profiles and products kept in different stores.

It will be understood that the invention is not restricted to the embodiment described above by way of example, and that modifications can be made within the framework of the inventive concept as defined in the accompanying claims. It will be noted in particular that each illustrated unit and/or circuit can be combined with each other illustrated unit and/or circuit within the framework of being able to achieve a desired technical function.

What is claimed is:

1. A branch sleeve for crimping at least two electrically conductive conductor sections positioned closely parallel with one another, the sleeve comprising:

a first groove-shaped recess;

a second groove-shaped recess connected to and arranged in relation to said first recess to define an open part between and coordinated with said first recess;

a first leg section being formed with and defining said first recess and having a terminating tip, said first recess being formed to freely embrace a first electrical conductor section;

a second leg section being formed with and defining said second recess and having a terminating tip, said second recess being formed to freely embrace a second electrical conductor section;

said first and second leg sections and first and second recesses define an opening area that generally conforms to and exceeds in size the largest conductor section area for which the sleeve is dimensioned;

said sleeve having the form of a stylized digit three;

the sleeve material distribution intermediate said first and second recesses is formed with centrally increased material gathering, said first and second leg sections extending from said centrally increased material gathering and reducing in material thickness toward said terminating tips;

wherein the reduced material forming said leg sections is structured to be mutually coordinated in an overlapping relationship resulting from a crimping process, wherein during the crimping process said leg sections utilize a rolling and folding movement causing said leg sections to embrace the first and second conductor sections, and wherein after the crimping process the first and second conductor sections are in contact with each other.

2. The sleeve according to claim 1, wherein one of the closely parallel sections is chosen to lie within said first recess in respect of lateral infeed of the conductor section, the cross-sectional area of the conductor section ranging between 50 and 10 $mm^2$.

3. The sleeve according to claim 1, wherein in respect of a frontal infeed of one conductor section, the conductor section is chosen within a cross-sectional area ranging between 35 and 10 $mm^2$.

4. The sleeve according to claim 1, wherein said recesses are configured for co-action with the closely parallel conductor sections that are to be spliced to provide a branch in an earth line and/or in a lightning arrester installation.

5. The sleeve according to claim 1, wherein said first and second recesses formed by said first and second legs have different size embracing areas.

6. The sleeve according to claim 1, wherein said first and second terminating tips have flat planar surfaces, said flat planar surfaces having angles oriented to allow said terminating tips to slide above and below each other respectively when said rolling movement is activated by said crimping.

7. The sleeve according to claim 1, wherein the reducing in material thickness toward said terminating tips of said first and second leg sections is asymmetric.

8. A branch sleeve for crimping at least two electrically conductive conductor sections positioned closely parallel with one another, the sleeve comprising:

a first groove-shaped recess;

a second groove-shaped recess connected to and arranged in relation to said first recess to define an open part between and coordinated with said first recess;

a first leg section being formed with and defining said first recess and having a terminating tip, said first recess being formed to freely embrace a first electrical conductor section;

a second leg section being formed with and defining said second recess and having a terminating tip, said second recess being formed to freely embrace a second electrical conductor section;

said first and second leg sections and first and second recesses define an opening area that generally conforms to and exceeds in size the largest conductor section area for which the sleeve is dimensioned;

said sleeve having the form of a stylized digit three;

the sleeve material distribution intermediate said first and second recesses is formed with centrally increased material gathering, said first and second leg sections extending from said centrally increased material gathering and reducing in material thickness toward said terminating tips;

wherein the reduced material forming said leg sections is structured to be mutually coordinated in an overlapping relationship resulting from a crimping process, wherein during the crimping process said leg sections utilize a rolling and folding movement causing said leg sections to embrace the first and second conductor sections;

wherein said first and second terminating tips have flat planar surfaces, said flat planar surfaces having angles oriented to allow said terminating tips to slide above and below each other respectively when said rolling movement is activated by said crimping; and, wherein one said terminating tip has a bottom surface angle ranging between 40 and 60 degrees, and said terminating tip has a top surface angle ranging between 110 and 120 degrees.

* * * * *